US006034589A

United States Patent [19]

Montgomery et al.

[11] Patent Number: 6,034,589

[45] Date of Patent: Mar. 7, 2000

[54] MULTI-LAYER AND MULTI-ELEMENT MONOLITHIC SURFACE MOUNT FUSE AND METHOD OF MAKING THE SAME

[75] Inventors: Jeffrey D. Montgomery; Xiangming Li; Daniel H. Chang; Kenneth M. Wallace; Kenneth X. Kuang, all of San Diego, Calif.

[73] Assignee: AEM, Inc., San Diego, Calif.

[21] Appl. No.: 09/213,148

[22] Filed: Dec. 17, 1998

[51] Int. Cl.[7] ..... H01H 85/055; H01H 85/08; H01H 85/38; H01H 85/046; H01H 69/02

[52] U.S. Cl. ..... 337/296; 337/297; 337/395; 337/290; 29/623

[58] Field of Search ..... 337/296, 297, 337/164, 293, 160, 290, 295; 29/623

[56] References Cited

U.S. PATENT DOCUMENTS

| | | | |
|---|---|---|---|
| 3,401,452 | 9/1968 | Regan | 29/623 |
| 3,810,063 | 5/1974 | Blewitt | 337/166 |
| 4,164,725 | 8/1979 | Wiebe | 337/198 |
| 4,263,574 | 4/1981 | Mori et al. | 337/161 |
| 4,417,225 | 11/1983 | Muller et al. | 337/198 |
| 4,547,830 | 10/1985 | Yamauchi | 361/104 |
| 4,626,818 | 12/1986 | Hilgers . | |
| 4,873,506 | 10/1989 | Gurevich | 337/290 |
| 5,099,218 | 3/1992 | Salisbury | 337/296 |
| 5,144,523 | 9/1992 | Pageaud et al. | 361/308 |
| 5,166,656 | 11/1992 | Badihi et al. . | |
| 5,228,188 | 7/1993 | Badihi et al. . | |
| 5,296,833 | 3/1994 | Breen et al. . | |
| 5,406,245 | 4/1995 | Smith et al. | 337/273 |
| 5,408,053 | 4/1995 | Young | 174/264 |
| 5,420,560 | 5/1995 | Hanada . | |
| 5,432,378 | 7/1995 | Whitney et al. . | |
| 5,440,802 | 8/1995 | Whitney et al. . | |
| 5,453,726 | 9/1995 | Montgomery | 337/290 |
| 5,479,147 | 12/1995 | Montgomery . | |
| 5,552,757 | 9/1996 | Blecha et al. . | |
| 5,598,138 | 1/1997 | Jaronczyk, Jr. | 337/265 |
| 5,604,477 | 2/1997 | Rainer et al. . | |
| 5,621,375 | 4/1997 | Gurevich . | |
| 5,726,621 | 3/1998 | Whitney et al. | 337/297 |
| 5,818,320 | 10/1998 | Matsuoka | 337/198 |
| 5,864,277 | 1/1999 | Grimm et al. | 337/297 |
| 5,898,357 | 4/1999 | Endo et al. | 337/159 |
| 5,917,399 | 6/1999 | Ishii | 337/290 |

*Primary Examiner*—Leo P. Picard
*Assistant Examiner*—Anatoly Vortman
*Attorney, Agent, or Firm*—McGinn & Gibb, P.C.

[57] ABSTRACT

A surface mount fuse includes a plurality of substrate/arc suppressive layers, a plurality of fusible elements positioned between the substrate/arc suppressive layers and terminations connected to the ends of the fusible elements, such that the fusible elements are electrically connected in parallel. The surface mount fuse has greater amperage and voltage ratings than similarly sized conventional surface mount fuses. Additionally, the surface mount fuse has increased interrupt breaking capacity and superior mechanical properties.

16 Claims, 3 Drawing Sheets

MULTI-LAYER AND MULTI-ELEMENT MONOLITHIC SURFACE MOUNT FUSE AND METHOD OF MAKING THE SAME

BACKGROUND OF THE INVENTION

1. Field of the Invention

The present invention relates generally to electrical fuses and particularly to surface mount chip fuses employing a new and improved multi-layer, multi-element monolithic construction. The invention farther relates to the methods for manufacturing and fabricating such fuses.

2. Description of the Related Art

The utilization of surface mount components on printed circuit boards has become the preferred method for circuit board assembly as device geometries continually decrease in size and overall circuit density continues to increase. Several advantages of surface mount components over older leaded devices (used in through-hole technology) include decreased size, decreased weight and lower profile. Additionally, the use of surface mount components generally lowers manufacturing costs by allowing the use of highly automated assembly equipment. The shift from leaded components to surface mount components by the electronics industry has resulted in greater demands for smaller, higher reliability, less costly surface mount fuses with greater amperage and voltage ratings.

Surface mount fuses allow the circuit designer to protect critical (and oftentimes expensive) components and circuitry at the board level or subsystem level rather than relying on an external fuse or some other external current protection device. Overload current may result from a wide variety of sources. Short circuit conditions can occur in filter capacitors, supply lines or output loads which cause overload current flow. To provide adequate protection to sensitive electronics, the clear-time characteristics of surface mount fuses used in these applications must be very fast and extremely predictable.

Conventional surface mount chip fuses have numerous limitations. The most notable limitation is amperage rating. Generally, surface mount chip fuses (e.g., 1206 size and smaller) are limited to ratings of 5.0 amperes and less. 1206 refers to a component size which is approximately 120 mils in length by 60 mils in width. This terminology is common in the chip component industry (others include 0805, 0603, and 0402). One reason for the amperage limitations of traditional chip fuses is related to the fusing element employed by these devices. Many of these devices utilize thin film techniques for deposition of the fusing element.

A typical example of this type of fuse is disclosed in U.S. Pat. No. 5,296,833 to Breen et al. This patent discloses a thin film fuse which is constructed by depositing a thin metal layer on an insulative substrate, bonding an insulative coating to the upper surface of the insulative substrate and bonding secondary cover layers of greater mechanical strength to the bottom and top of entire assembly. The object of the Breen et al. device is to provide a thin film fuse of higher voltage rating than previously possible while maintaining quick clear-times. A second object of the Breen et al. invention is to provide a thin film fuse structure that has improved mechanical strength and reliability, as well as greater thermal cycling ability.

Other conventional surface mount chip fuses have been fabricated with wire fusing elements. Amperage ratings for these devices are controlled by increasing or decreasing the diameter of the fusible wire. A typical example of this type of fuse is disclosed in U.S. Pat. No. 5,440,802 to Whitney et al. This patent discloses a method of manufacturing chip fuses in which a plurality of spaced, parallel columns of electrically-conductive film are deposited on an upper surface of a green ceramic plate. A plurality of electrically-conductive wire elements are deposited on the upper surface of the plate in a mutually parallel spaced relationship and substantially perpendicular to the film columns. A cover plate of unfired ceramic material is bonded to the upper surface of the plate. The cover plate covers the film columns and wire elements, to form a laminate structure. The laminate structure is divided, to form a plurality of individual fuses. The fuses are fired to cure the ceramic, and to create an inter-metallic bond between the wire elements and the conductive metal film at mutual points of contact.

Fuses constructed in this manner are limited to lower amperage and voltage ratings (less than 5.0 amps and 36 VDC) due to their limited ability to suppress arcs which may occur during the clearing action when an overload current is present. The reason for these amperage/voltage limitations is that during a clearing action (e.g., the "blowing" of the fuse), the fuse element material should be completely absorbed by the surrounding substrate layers. If the fuse element material protrudes from the surrounding substrate layers, the fuse material may continue to allow large amounts of current to pass and not effectively open the circuit.

Higher amperage devices require larger diameter fusing wires to handle steady state load currents. Thus, more fuse element material must be displaced when a 5.0 amp fuse is cleared than when a 1.0 amp fuse is cleared. The larger mass of element material utilized in the higher amperage devices often results in an increased probability that the surrounding arc suppressive layer will become saturated with the fusing material during a clearing action which can lead to catastrophic failure (e.g., a fuse which does not properly open a given circuit).

Some conventional non-surface mount fuses and fuse assemblies have addressed the need for higher voltage and amperage capabilities through the use of multiple fusing elements. For example, U.S. Pat. No. 5,479,147 to Montgomery (one of the present inventors) discloses a fuse assembly comprising a plurality of thick film elements or a combination of thick film and wire fusing elements which are formed on a single substrate in an electrically parallel configuration to provide for higher voltage/current capability. Although the fuses described in U.S. Pat. No. 5,479,147 provide higher voltage capability, the package size must be larger to accommodate the wider fusing elements.

SUMMARY OF THE INVENTION

In view of the foregoing problems of the conventional fuses, an object of the present invention is to provide a monolithic surface mount chip fuse which overcomes the amperage and voltage limitations of the conventional structures in a smaller package with higher interrupt breaking capacity than that of conventional structures.

An additional object of the present invention is to provide a surface mount chip fuse which utilizes multiple fusible elements and which has increased mechanical strength and improved thermal cycling capabilities.

A further object of the present invention is to provide a surface mount chip fuse with improved soldering heat and chemical resistance, and to provide a surface mount chip fuse which can be easily manufactured at low cost.

The invention achieves the above (and other) objects with a surface mount fuse that includes a plurality of substrate/arc suppressive layers, a plurality of fusible elements positioned between the substrate/arc suppressive layers and terminations connected to the ends of the fusible elements, such that the fusible elements are electrically connected in parallel.

The inventive surface mount fuse comprises of a plurality of substrate/arc suppressive layers and a plurality of fusible elements respectively positioned between the substrate/arc suppressive layers, each having end portions and terminations connected to the end portions of the fusible elements, such that the fusible elements are electrically connected in parallel.

The substrate/arc suppressive layers each include a lower substrate/arc suppressive layer having sides, an upper substrate/arc suppressive layer having sides and at least one intermediate substrate/arc suppressive layer having sides. Further, the lower substrate/arc suppressive layer has a lower surface and the upper substrate/arc suppressive layer has an upper surface. The terminations cover the sides of the upper substrate/arc suppressive layer, the sides of the lower substrate/arc suppressive layer, the sides of the intermediate substrate/arc suppressive layer, the end portions of the fusible elements, a portion of the upper surface of the upper substrate/arc suppressive layer and a portion of the lower surface of the lower substrate/arc suppressive layer.

The upper substrate/arc suppressive layer has a first thickness, the lower substrate/arc suppressive layer has the first thickness and at least one intermediate substrate/arc suppressive layers have a second thickness, wherein the first thickness is greater than the second thickness.

The terminations comprise an inner termination layer directly connected to the sides of the lower substrate/arc suppressive layer, the sides of the upper substrate/arc suppressive layer, the sides of at least one intermediate substrate/arc suppressive layer and the end portions of the fusible elements. An intermediate termination layer connects to the inner termination layer and an outer termination layer connects to the intermediate termination layer.

Further, the inner termination layer comprises silver, the intermediate termination layer comprises nickel and the outer termination layer comprises an alloy of tin and lead. The substrate/arc suppressive layers comprise a mixture of glass and ceramic with at least one of zirconia, calcium borosilicate, alumina, soda lime, alumino-silicate, lead-boro-silicate and halogen salts. In addition, the fusible element comprises at least one of gold, silver, copper, aluminum, palladium and platinum.

The fusible elements include a neck-down portion connected to the end portions, wherein the neck-down portion has a width less than that of the end portions.

The surface mount fuse wherein the end portions comprise of at least one of silver, copper, aluminum and palladium and the neck-down portion comprises at least one of gold, silver, copper, aluminum, platinum and palladium.

Also, the surface mount fuse wherein the fusible elements comprise a composite of a conductive metal and an arc suppressive glass. The end portions comprise at least one of silver, copper, aluminum and palladium and the neck-down portion comprises a composite of a conductive metal and an arc suppressive glass.

A method of forming the invention surface mount fuse comprises depositing a fusible element on an substrate/arc suppressive layer, repeating the depositing step to form a laminated structure and forming terminations on ends of the laminated structure. The method further comprises, prior to forming terminations, cutting the laminated structure into a plurality of individual surface mount fuses.

The depositing comprises one of screen printing, stencil printing, plating, stamping/film transfer, electro forming, chemical vapor deposition and sputtering. The method further comprises forming a lower substrate/arc suppressive layer to have a first thickness, forming an upper substrate/arc suppressive layer to have the first thickness, and forming at least one intermediate substrate/arc suppressive layer, between the fusible elements, to have a second thickness, wherein the first thickness is greater than the second thickness.

Also, the method further comprises forming a lower substrate/arc suppressive layer having a lower surface and forming an upper substrate/arc suppressive layer to have an upper surface. The forming of the terminations comprises forming the terminations on a portion of the lower surface of the lower substrate/arc suppressive layer and forming the terminations on a portion of the upper surface of the upper substrate/arc suppressive layer. The forming of the terminations also comprises forming a silver layer on the laminated structure, forming a nickel layer on the silver layer and forming an alloy comprising of tin and lead on the nickel layer.

The method further comprises forming the substrate/arc suppressive layer to include a mixture of glass and ceramic with at least one of zirconia, calcium boro-silicate, alumina, soda lime, alumino-silicate, lead-boro-silicate, silica and halogen salts.

The depositing of a fusible element comprises forming end portions having a first width and forming a neck-down portion, connected to the end portions, having a second width, wherein the first width is greater than the second width. Forming the end portions comprises depositing at least one of silver, copper, aluminum and palladium and forming the neck portion comprises depositing gold.

With the inventive surface mount fuse, a higher voltage and amperage rating can be achieved in a smaller package which has increased mechanical strength, improved thermal cycling, chemical resistance and soldering heat and which can be manufactured at lower cost.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
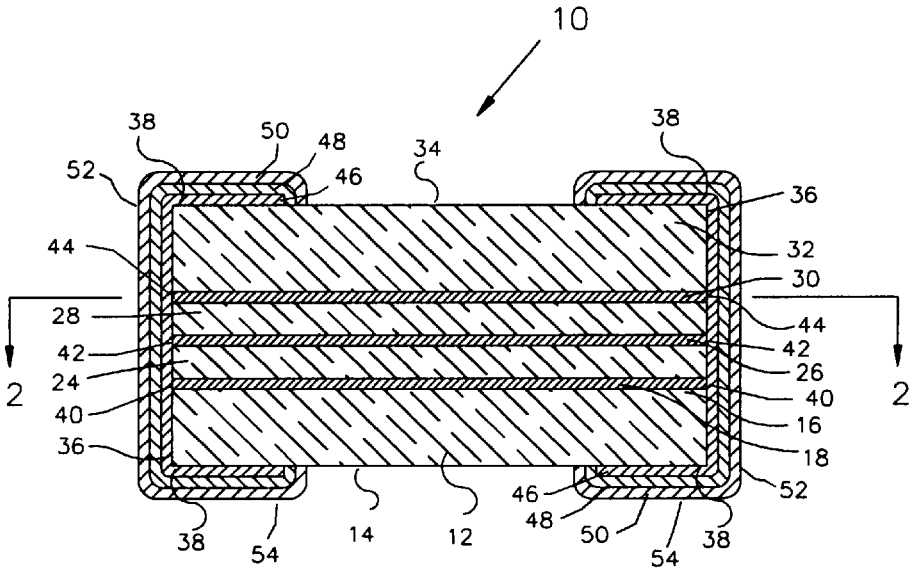
FIG. 1 is a side elevation view, in cross section, of a fuse in accordance with the present invention.

Referring now to the drawings, FIGS. 1, 2, 3 and 4 illustrate the structure of a surface mount chip fuse 10 in accordance with the invention. In the drawings, the metallization layers have been greatly exaggerated to aid in the understanding of the invention.

As shown in FIG. 1, the fuse 10 includes a lower substrate/arc suppressive layer 12. The lower substrate/arc suppressive layer 12 has a lower surface 14 and upper surface 16. The preferred substrate/arc suppressive material is a zirconia/glass ceramic composite. Other acceptable substrate/arc suppressive materials are those constructed from calcium boro-silicate and alumina substrates (alone or in combination) which are formulated with a relatively high percentage (e.g., 30% or more) of glass so as to be a good electrical and thermal insulator.

The lower substrate/arc suppressive layer 12 can be formed either by green tape lamination, by slurry curtain coating process or other multi-layer build-up processes which are known to those ordinarily skilled in the art and are discussed in more detail below.

A lower fusible element 18 is deposited on an upper surface 16 of lower substrate/arc suppressive layer 12. The lower fusible element 18 includes end portions 20 which are wider than a neck-down area 22. Briefly, a neck-down area is defined as a narrowing of a layer of material and creates a substantially bow-tie shape in the fusible element, when viewed from above, to concentrate the current and promote the clearing action. The thickness and geometry of the lower fusible element 18 may be adjusted in accordance with amperage, voltage and clearing requirements of the fuse, as is commonly known by those skilled in the art.

Specifically, the thickness and or width of the neck-down area 22 is the area which will overheat and melt (e.g., "blow" or "clear") to allow the lower fusible element 18 to open when an overload current or voltage is passed through the fuse. When the neck-down area 22 clears, it migrates into the surrounding substrate/arc suppressive layers, but does not make the substrate/arc suppressive layers conductive. Therefore, when the neck-down area 22 clears, the fusible element will become non-conductive. Alternatively, the fuse element material could include any number of suitable conductive metals such as silver, copper, aluminum, palladium, platinum, other noble metals, etc, alone or in combination, as is known by those ordinarily skilled in the art.

As an alternative embodiment, the fusible elements may comprise wires. Additionally, the fuse element material could be a composite formed from a conductive material and an arc suppressive glass. The preferred fusible element material is gold because gold readily migrates into the preferred substrate/arc suppressive material. Alternatively, the fuse element material could include any number of suitable conductive metals such as silver, copper, aluminum, palladium, other noble metals, etc. (alone or in combination) as is known by those ordinarily skilled in the art.

A preferred method for depositing the lower fusible element 18 on the lower substrate/arc suppressive layer 12 is by screen printing. Other acceptable methods of fusible element deposition which are known to those skilled in the art include, but are not limited to, stencil printing, plating, chemical deposition and sputtering.

An intermediate substrate/arc suppressive layer 24 is formed over the lower fusible element 18 in a similar manner as the lower substrate/arc suppressive layer 12. Similarly, an intermediate fusible element 26, a second intermediate substrate/arc suppressive layer 28, an upper fusible element 30 and an upper substrate/arc suppressive layer 32 are formed in the manner discussed above to form the structures shown in FIGS. 1 and 2.

Preferably, all fusible elements 18, 26, 30 are formed of the same material and have the same dimensions for economies in manufacturing. However, some applications may preferably require that the fusible elements have different dimensions. For example, the upper and lower fusible elements (e.g., item numbers 18 and 30) may be larger than the intermediate fusible elements (e.g., item number 26) so that the fuse can provide specific or unique clearing characteristics.

As illustrated in FIG. 1, the upper and lower substrate/arc suppressive layers 12 and 32 may be larger than the remaining substrate/arc suppressive layers. The added mechanical strength is provided to insure that the outer surface of the fuse is not ruptured when the fuse is blown.

However, a specific application may include equally thick substrate/arc suppressive layers or thinner upper and lower substrate/arc suppressive layers, where, for example, space requirements are paramount.

Similarly, while the foregoing embodiment utilizes the same material for all substrate/arc suppressive layers, it may be preferable, in a given situation, to form the intermediate substrate/arc suppressive layers of different materials than the upper and lower substrate/arc suppressive layers. For example, ceramics can be used as the upper and lower layers to provide better mechanical strength and cosmetic properties, while glass/ceramic composites are preferred as the intermediate layers to provide better substrate/arc suppressive properties.

Further, while three fusible elements and five substrate/arc suppressive layers are illustrated in FIG. 1, a specific application could preferably require many more or less of such layers. For example, increasing the number of fusible elements would increase the amperage and voltage rating of the fuse, so long as the size of the fusible element remained constant. Alternatively, one could increase the number of fusible elements while decreasing the size of each fusible element to maintain a given amperage and voltage rating for the fuse.

Therefore, in accordance with the present invention, controlling the number and thickness of the fusible element layers and the thickness of substrate/arc suppressive layers between fusible elements provides for a wide range of amperage and voltage capabilities.

For example, an alloy fusible element having a neck-down area 22 with a width of approximately 6 mils and a print thickness of 6 microns provides a 2.0 amp fuse. Sandwiching five of such 2.0 amp fusible elements 18 into a single fuse 10 will provide a 10.0 amp fuse.

The end surfaces 36 of the fusible element and substrate/arc suppressive layers are covered by conductive terminations 52 which comprise an inner layer 46, an intermediate layer 48 and an outer layer 50. The terminations 52 and 54 are placed in a series circuit path, such that the fuse 10 becomes part of the circuit path.

The inner layer 46 is preferably formed of silver, the intermediate layer 48 is preferably formed of nickel and the outer layer 50 is preferably formed of a tin/lead alloy. This three-layer structure provides the benefit of good solderability and leach resistance. When an overload condition (e.g., excessive current) occurs, the neck-down areas 22 of each of the fusible elements simultaneously melt and migrate into the surrounding substrate/arc suppressive layers 12, 24, 28, 32 (e.g. the fuse "clears").

Therefore, the inventive fuse structure would only produce a single current drop upon clearing and would not produce a series of current drops upon clearing. The thickness of the substrate/arc suppressive layers should be sufficient (depending upon the application environment) to allow the volume of fusible material from the neck-down areas 22 to be completely absorbed without allowing the substrate/arc suppressive layers to become conductive.

The terminations 52 also include lands 54 extending around the corners 38 and along the upper surface 34 of the upper substrate/arc suppressive layer 32 and the lower surface 14 of the lower substrate/arc suppressive layer 12. The structure promotes a strong mechanical bonding between the terminations and the fuse body.

The fuse structure 10 illustrated in FIG. 1 operates as follows. The terminations 52 are placed in a circuit path, such that the fuse 10 becomes part of the circuit path. Each of the fusible elements is supplied with substantially the same current and voltage because each fusible element is similarly connected to the terminations. When an overload condition (e.g., excessive voltage or current) occurs, the neck-down portions 22 of each of the fusible elements simultaneously melt and migrate into the surrounding substrate/arc suppressive layers 12, 24, 28, 32 (e.g., the fuse "clears"). Since all of the neck-down portions 22 are destroyed, essentially no current can pass through the fuse 10 which causes a break (e.g., open) in the circuit path.

The thickness of the substrate/arc suppressive layers should be sufficient (depending upon the application and environment) to allow the volume of fusible material from the neck-down areas 22 to be completely absorbed without allowing the substrate/arc suppressive layers to become conductive. Further, the upper and lower substrate/arc suppressive layers should be thick enough (depending upon the application and environment) to ensure that the upper and lower fusible elements do not breach the package during a clearing action. This will ensure that the fuse will conduct substantially no current after an overload condition.

As mentioned above, the size of each of the fusible elements can be varied to provide that the fusible elements clear in a controlled manner so as to reduce the chance of package breach. However, in such a structure, even with different sized fusible elements, the fusible elements all clear at substantially the same time.

Similarly, increasing the number and/or thickness of the substrate/arc suppressive layers between the fusible element layers provides a fuse with more mechanical strength and greater voltage capability.

Further, the clearing time of the fuse can also be controlled by the thickness of the substrate/arc suppressive layers between adjacent fusible element layers because of the heat transferred between the fusible elements. Specifically, the end portions 20 are made of a relatively low-cost material such as silver, copper, aluminum, palladium and other noble metals (alone or in combination), while only the neck-down are 22 is formed of the more expensive, specially formulated, fusible material. Each fusible element heats adjacent fusible elements during an overload current situation. The thinner the intermediate substrate/arc suppressive layer, the more heat will be transferred between the fusible elements. Likewise slower blowing devices are formed by increasing the intermediate substrate/arc suppressive layer thickness. Specifically, the end portions 20 are made of relatively low-cost material such as silver, copper, aluminum, palladium and other noble metals (alone or in combination), while only the neck-down are 22 is formed of the more expensive, specially formulated, fusible material such as gold.

Figure 4:
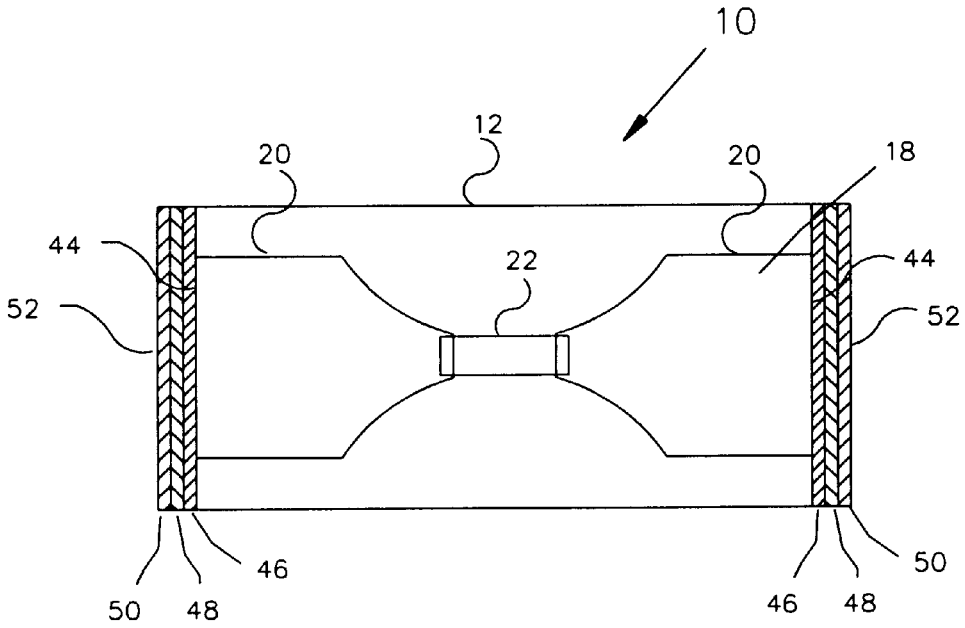
FIG. 4 is a cross-sectional view of the inventive fuse as seen along lines 2—2 showing a second stage of the method for fabricating the fusible element.

FIG. 4 illustrates the step of completing the fusible element 18 by forming the neck-down are 22 of fusible material by screen printing, stamping, film transfer or other methods well known to those ordinarily skilled in the art.

Second Embodiment

Figure 2:
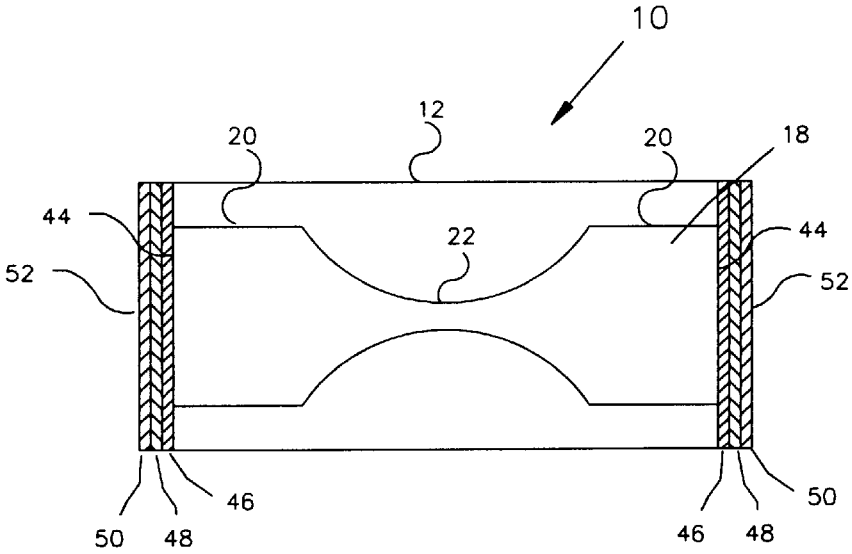
FIG. 2 is a cross-sectional view of the inventive fuse as seen along lines 2—2.

An alternative structure of the fusible element is shown in FIG. 4 and is substantially similar to the structure shown in FIG. 2 except that the neck-down portion 22 is formed of a different material than the end portions 20. Specifically. the end portions 20 are made of a low cost material such as silver, copper, aluminum, palladium and other noble metals (alone or in combination). Increased thermal cycling is achievable because the superior mechanical properties of the ceramic/glass composite is by nature very stable in a wide variety of environments. Improved soldering heat resistance survivability is also a function of the nature of the ceramic/glass composite material utilized (as compared to many surface mount fuses constructed with polymer based bodies). Increased breaking capacity is primarily a function to the multiple low mass elements utilized. Only the neck-down portion 22 is formed of the more expensive gold material. This allows the fusible elements to be manufactured at lower cost.

Figure 3:
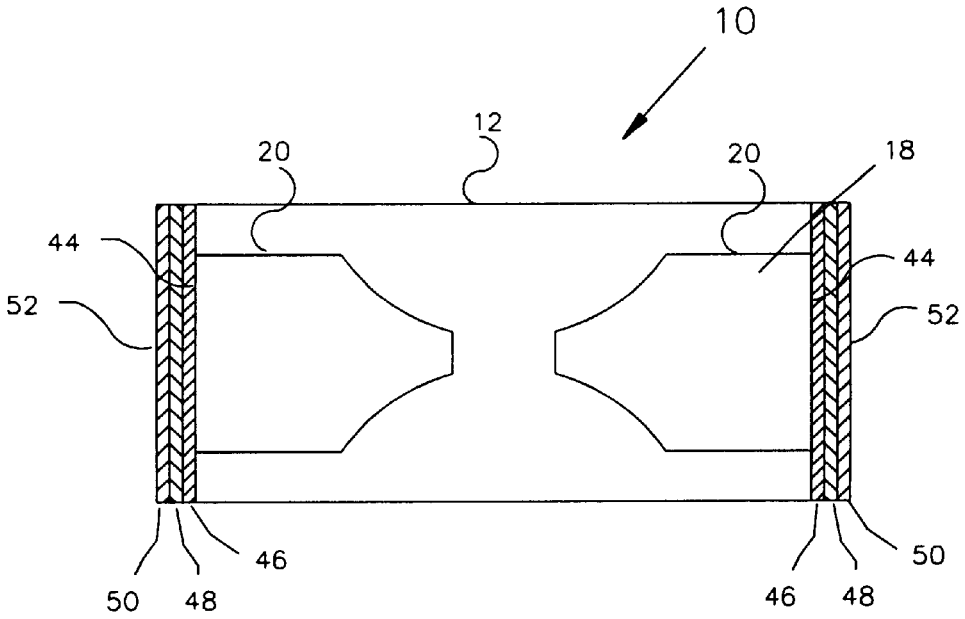
FIG. 3 is a cross-sectional view of the inventive fuse as seen along lines 2—2 showing a first stage of a method for fabricating the fusible element.

A preferred method of manufacturing the fusible element shown in FIG. 4 is shown in FIGS. 3 and 4. FIG. 3 illustrates a first step of forming the fusible element 18, whereby end portions 20 of silver or another relatively low cost material are formed by screen printing or other similar process well known to those ordinarily skilled in the art. FIG. 4 illustrates the step of completing the fusible element 18 by forming the neck-down area 22 of fusible material by screen printing, stamping, film transfer, or other methods well known to those ordinarily skilled in the art.

After the lower substrate/arc suppressive layer 12 is formed, fusible elements 18 are screen printed and the entire structure is dried at 50 to 150° C. (with or without UV light) to remove solvents and solidify the fusible element. The method of construction of the second embodiment provides for lower manufacturing cost because less costly metals are utilized to form the non-critical end portions 20 of the fusible element 18, while the neck-down area 22 (which is critical for providing consistent opening times and high open resistance values) requires only a relatively small amount of the more expensive, specially formulated, fusible material.

Manufacturing Methods

Figure 5:
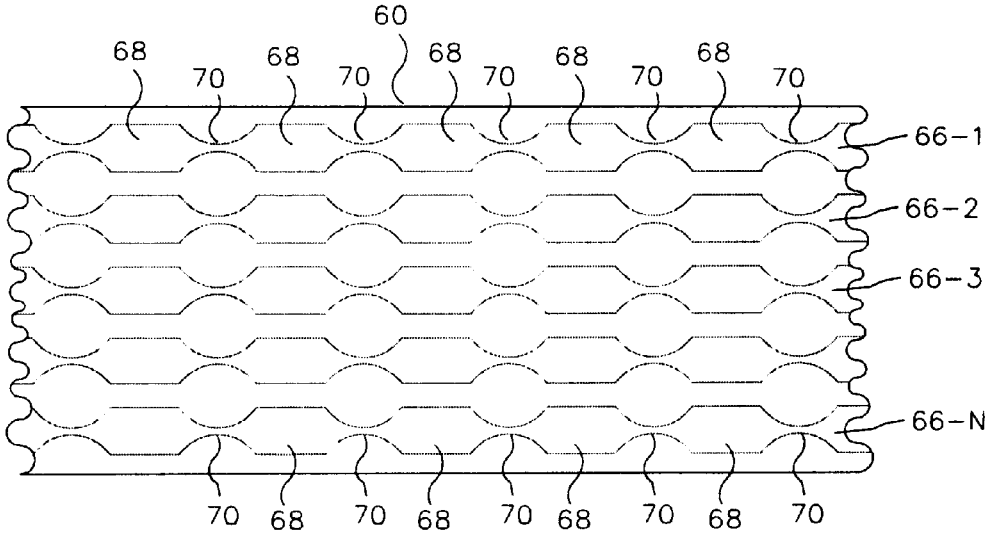
FIG. 5 is a top plan view showing the inventive fusing elements deposited on a substrate at an intermediate manufacturing point.
Figure 6:
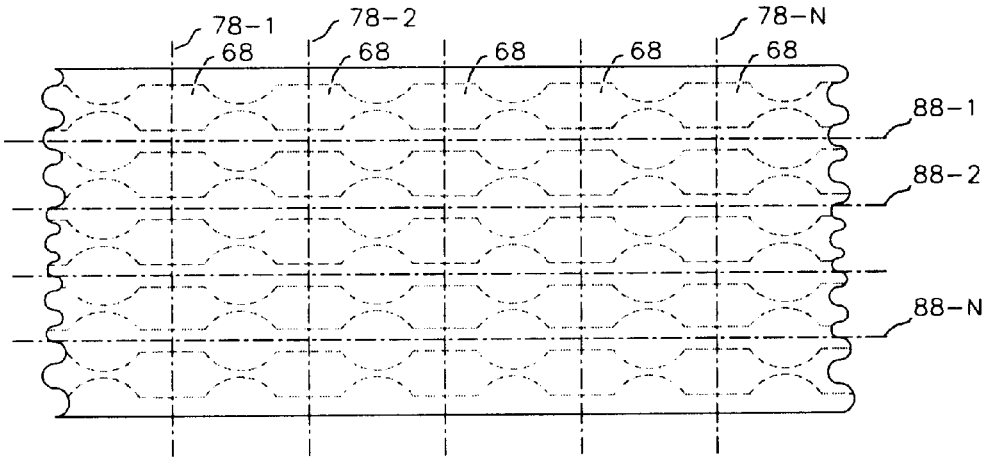
FIG. 6 is a top plan view showing cut lines for separating the inventive fuses from the manufacturing plate.

FIGS. 5 and 6 illustrate a method of simultaneously manufacturing multiple inventive multi-layer, multi-element surface mount fuses 10. FIG. 5 illustrates a first step of depositing multiple rows of fusible elements 66-1, 66-2, 66-3, . . . 66-N on an arc suppressive layer 12. The size of the substrate/arc suppressive layer 12 will vary and can be sized to accommodate thousands of individual fuses. Each fusible element 18 is distinguishable by a wider portion 68 and a neck-down portion 70 (corresponding to elements 20 and 22, respectively, in FIG. 2).

In a preferred embodiment of the present invention, the fusible elements are screen printed (in the form of a green tape) onto the upper surface 16 of the lower substrate/arc suppressive layer 12. Depending on the voltage and current requirements of the fuse 10, the number and thickness of the substrate/arc suppressive layer(s) which form the lower substrate/arc suppressive layer 12 of the fuse may vary. As mentioned above, a thicker lower and upper substrate/arc suppressive layer will allow the formation of higher amperage/voltage rated fuses.

After the lower substrate/arc suppressive layer 12 is formed, fusible elements 18 are screen printed and the entire structure is dried at 50 to 150° C. (with or without UV light) to remove the solvents and solidify in the fusible element ink.

An intermediate substrate/arc suppressive layer (e.g., layer 24 shown in FIG. 1) and intermediate fusible element layer (e.g., layer 26 shown in FIG. 1) are then formed by similar methods. This process is repeated so that multiple alternating layers of fusible elements and substrate/arc suppressive layers are formed. As mentioned above, the number of layers of fusible elements which are formed depends upon the amperage requirements of the fuse.

An upper substrate/arc suppressive layer (e.g., layer 32 in FIG. 1) is formed of similar dimensions and by a similar process as the lower substrate/arc suppressive layer 12. The number and thickness of the substrate/arc suppressive layer (s) which form the lower substrate/arc suppressive layer 12 and the upper arc suppressive layer 32 of the fuse can be varied depending on the voltage and current requirements of the fuse.

After formation of the various fusible element layers and substrate/arc suppressive layers, the ceramic green tapes are heated to approximately 70° C. and laminated at a relatively high pressure (e.g., 5K psi). Following the lamination process, the fuses are processed in a similar manner as known to those skilled in the art of the multi-layer capacitor industry. These processes include green tape drying, cutting of the green tape to form individual fuses, binder burn-out and final firing, to sinter both the substrate/arc suppressive and fusible element layers.

FIG. 6 illustrates cut lines for dividing the laminated structure into individual fuses. Specifically, parallel planes 78-1, 78-2, . . . 78-N indicate the cut areas in the "y" axis direction while parallel planes 88-1, 88-2, . . . 88-N indicate the cut areas in the "x" axis direction. Cutting may be accomplished by blade cutting, diamond saw cutting or other means as is well known to those ordinarily skilled in the art.

Another method of manufacturing the fuse of the present invention includes a wet build-up process, as is also known to those ordinarily skilled in the art of multi-layer capacitors.

More specifically, the wet build-up process includes a step of preparing a uniform ceramic/glass slurry and curtain coating a Mylar (e.g., a polyester fill—Trademark of E. I. du Ponte de Nemours & Co., Inc.) sheet to form the substrate/arc suppressive layer 12. Again the thickness of the lower substrate/arc suppressive layer can be varied, per the voltage and mechanical requirements of the fuse, by controlling the number of curtain coatings.

The fusible element layer 18 is then deposited on the lower substrate/arc suppressive layer 12. As described above, a second coating of the intermediate substrate/arc suppressive layer 24 is then applied over the deposited fusible element 18. The above process is repeated until the desired number of alternate layers of fusible elements 18, 26, 30 and substrate/arc suppressive layers 12, 24, 28, 32 are formed.

The resulting multi-layer structure is then processed in a similar manner as described above, a second coating of the intermediate substrate/arc suppressive layer 24 is then applied over the deposited fusible element 18. These processes include drying, cutting, binder burn-out, firing, metallizing of the fuse ends with thick film silver terminations 46, plating a nickel layer 48 and finally plating with a tin/lead alloy layer 50.

As also mentioned above with respect to the structure illustrated in FIG. 4, the fusible element layers may include a neck-down region 22 made of gold and end portions 20 made of a less expensive material. Such a structure would require an additional deposition step because the formation of the fusible element layers would require a step of forming the end portions 20 and neck-down region 22 separately.

Similarly, as mentioned above, the materials used for the substrate/arc suppressive layers can be varied depending upon the specific design requirements.

Therefore, the inventive fuse includes multiple mass fusing layers separated by substrate/arc suppressive layers which reduces the possibility of substrate/arc suppressive layer saturation during a clearing action. The fuse of the present invention sandwiches low mass fusing elements vertically (rather than horizontally) and thus provides for a much more compact (and surface mountable) package.

Additionally, sandwiching the fusible elements provides for a faster clearing fuse (as opposed to the fuse assembly disclosed in U.S. Pat. No. 5,479,147) because the fusible element heat generated during a clearing action is more localized (e.g., heat is more easily transferred between the individual fusible elements to promote the clearing action).

Additional benefits of the invention include a fuse which has higher mechanical strength, greater voltage/amperage rating, improved thermal cycling, improved chemical resistance, improved soldering heat and is more compact than conventional structures.

The above-described are merely illustrative of the principles and construction of the present invention. Numerous modifications and adaptations thereof will be readily apparent to those ordinarily skilled in the art without departing from the spirit and scope of the appended claims.

Having thus described our invention, what we claim as new and desire to secure by Letters Patent is as follows:

1. A surface mount fuse comprising:

a plurality of arc suppressive layers;

a plurality of fusible elements respectively positioned between said arc suppressive layers and each having end portions; and terminations connected to said end portions of said fusible elements, such that said fusible elements are electrically connected in parallel, wherein said arc suppressive layers include a lower arc suppressive layer, an upper arc suppressive layer and at least one intermediate arc supressive layer, said lower arc suppressive layer and said upper arc suppressive layer comprising a first material and said intermediate arc suppressive layer comprising a second material different than said first material.

2. The surface mount fuse as in claim 1, wherein said upper arc suppressive layer has a first thickness, said lower arc suppressive layer has said first thickness and said intermediate arc suppressive layer has a second thickness, wherein said first thickness is different than said second thickness.

3. The surface mount fuse as in claim 1, wherein said arc suppressive layers comprise a mixture of glass and ceramic with at least one of zirconia, calcium borosilicate, alumina, soda lime, alumino-silicate, lead-boro-silicate and halogen salts.

4. The surface mount fuse as in claim 1, wherein said fusible element comprise at least one of gold, silver, copper, aluminum, palladium and platinum.

5. The surface mount fuse as in claim 1, wherein each of said fusible elements include a neck-down portion connected to said end portions, wherein said neck-down portion has a width less than that of said end portions.

6. The surface mount fuse as in claim 5, wherein said end portions comprise at least one of silver, copper, aluminum and palladium and said neck-down portion comprises at least one of gold, silver, copper, aluminum, platinum and palladium.

7. The surface mount fuse in claim 5, wherein said end portions comprise at least one of silver, copper, aluminum and palladium and said neck-down portion comprises a composite of a conductive metal and an arc suppressive glass.

8. The surface mount fuse as in claim 1, wherein said fusible elements comprise a composite of a conductive metal and an arc suppressive glass.

9. The surface mount fuse in claim 1, wherein said first material has a higher mechanical strength than said second material.

10. The surface mount fuse in claim 1, wherein said first material comprises ceramic and said second material comprises a glass and ceramic material.

11. A surface mount fuse comprising:

a plurality of arc suppressive layers;

a plurality of fusible elements respectively positioned between said arc suppressive layers and each having end portions; and terminations connected to said end portions of said fusible elements, such that said fusible elements are electrically connected in parallel, wherein said arc suppressive layers include a lower arc suppressive layer having sides, an upper arc suppressive layer having sides and at least one intermediate arc suppressive layer having sides, and wherein said lower arc suppressive layer has a lower surface and said upper arc suppressive layer has an upper surface, said terminations covering said sides of said upper arc suppressive layer, said sides of said lower arc suppressive layer, said sides of said intermediate arc suppressive layer, said end portions of said fusible elements, a portion of said upper surface of said upper arc suppressive layer and a portion of said lower surface of said lower arc suppressive layer.

12. A surface mount fuse comprising:

a plurality of arc suppressive layers;

a plurality of fusible elements respectively positioned between said arc suppressive layers and each having end portions; and terminations connected to said end portions of said fusible elements, such that said fusible elements are electrically connected in parallel, wherein said arc suppressive layers each include a lower arc suppressive layer having sides, an upper arc suppressive layer having sides and at least one intermediate arc suppressive layer having sides, and wherein said terminations comprise:

an inner termination layer directly connected to said sides of said lower arc suppressive layer, said sides of said upper arc suppressive layer, said sides of said at least one intermediate arc suppressive layer and said end portions of said fusible elements;

an intermediate termination layer connected to said inner termination layer; and an outer termination layer connected to said intermediate termination layer.

13. The surface mount fuse as in claim 12, wherein said inner termination layer comprises silver, said intermediate termination layer comprises nickel and said outer termination layer comprises an alloy of tin and lead.

14. A surface mount fuse formed by a process comprising:

depositing a lower fusible element on a lower arc suppressive layer;

depositing an intermediate arc suppressive layer on said lower fusible element;

depositing an intermediate fusible element on said intermediate arc suppressive layer repeating said depositing of said intermediate arc suppressive layer and said intermediate fusible element to form a laminated structure;

depositing an upper arc suppressive layer on said intermediate fusible element, wherein said lower arc suppressive layer and said upper arc suppressive layer comprise a first material and said intermediate arc suppressive layer comprise a second material different than said first material; and forming terminations on ends of said laminated structure.

15. The surface mount fuse in claim 14, wherein said first material has a higher mechanical strength than said second material.

16. The surface mount fuse in claim 14, wherein said first material comprises ceramic and said second material comprises a glass and ceramic material.

* * * * *